US005845528A

United States Patent [19]

Wollermann

[11] Patent Number: 5,845,528

[45] Date of Patent: Dec. 8, 1998

[54] APPARATUS FOR CRIMPING TERMINALS ON AN ELECTRICAL CONDUCTOR

[75] Inventor: Kenneth A. Wollermann, Mukwonago, Wis.

[73] Assignee: Artos Engineering Company, Waukesha, Wis.

[21] Appl. No.: 946,139

[22] Filed: Oct. 7, 1997

[51] Int. Cl.[6] ..... B21J 9/19

[52] U.S. Cl. ..... 72/451; 72/454; 100/282; 29/753

[58] Field of Search ..... 72/450, 451, 454; 29/751, 753; 100/282

[56] References Cited

U.S. PATENT DOCUMENTS

| | | | |
|---|---|---|---|
| 1,871,321 | 8/1932 | Hayford et al. | 72/451 |
| 3,518,869 | 7/1970 | Forchicon | 72/451 |
| 4,932,237 | 6/1990 | Hatfield | 72/454 |
| 4,956,992 | 9/1990 | Undin | 72/454 |
| 5,084,960 | 2/1992 | Yeomans . | |
| 5,095,509 | 3/1992 | Gloe et al. . | |
| 5,228,326 | 7/1993 | Wqasilko et al. . | |
| 5,275,032 | 1/1994 | Gloe et al. . | |
| 5,289,713 | 3/1994 | Schafer . | |
| 5,337,589 | 8/1994 | Gloe et al. . | |
| 5,483,739 | 1/1996 | Smith et al. . | |
| 5,517,749 | 5/1996 | Zuin . | |
| 5,694,804 | 12/1997 | Grabbe | 72/451 |

OTHER PUBLICATIONS

"TU–8 Drive Direct Electronic Brake Press", Artos Engineering Company, Waukesha, WI 53187.

"Quick–Die" Modular Concept For Economical Terminal Attaching Applications, Bulleting No. A–82, Artos Engineering Company, Waukesha, WI 53187.

*Primary Examiner*—David Jones
*Attorney, Agent, or Firm*—Andrus, Sceales, Starke & Sawall

[57] ABSTRACT

An apparatus for crimping terminals on an electrical conductor including a novel mechanism for adjusting the crimp or shut height. An anvil is secured to a supporting structure and a ram is mounted for reciprocating movement on the supporting structure in a direction toward and away from the anvil. The anvil and the ram carry cooperating die members which act to crimp the terminal on a conductor which is positioned between the anvil and the ram. The ram is moved in reciprocating movement by a toggle mechanism which interconnects the ram and the supporting structure, and the toggle mechanism is movable between an under-center open position, an on-center crimping position and an over-center open position. The location of the pivotal connection of the toggle mechanism to the supporting structure can be adjusted to selectively vary the spacing between the die members when the toggle mechanism is in the on-center position to thereby adjust the crimp height.

14 Claims, 5 Drawing Sheets

APPARATUS FOR CRIMPING TERMINALS ON AN ELECTRICAL CONDUCTOR

BACKGROUND OF THE INVENTION

The conventional crimping machine for crimping an electrical terminal on the bare or exposed end of a wire or conductor includes a reciprocating ram which carries a crimping die that cooperates with a die mounted on a fixed anvil to crimp a first portion of the terminal onto the exposed end of the conductor and a second portion of the terminal onto the insulation adjacent the exposed end.

The crimp height is the height or vertical dimension of the terminal after crimping or deformation. The conventional crimping machine normally includes a provision to vary or adjust the crimp height. The need for adjustment could be due to wear of the components of the machine, or a variation in the type or size of the terminal or conductor.

Various methods have been used in the past to provide adjustment of the crimp height. One method is to utilize rotating cam plates, which can be indexed manually or automatically, which in effect changes the length of the ram stroke. Another method, as used in the past, has been to vary the length of the connecting linkage.

SUMMARY OF THE INVENTION

The invention is directed to an improved apparatus utilizing a toggle mechanism for crimping terminals to an electrical conductor and including a novel construction for adjusting the position of the connection of the toggle mechanism to the supporting structure to thereby adjust the crimp height.

With the construction of the invention, a ram is mounted for reciprocating movement on a frame or supporting structure in a direction toward and away from an anvil. The anvil and ram carry cooperating die members which act to crimp a terminal to the exposed end of the wire when the ram is moved in a direction toward the anvil. As is customary, a portion of the terminal is crimped to the bare or exposed wire and a second portion is crimped to the insulation adjacent the bare wire.

As a feature of the invention, toggle mechanism interconnects the ram and the supporting structure and serves to move the ram in a reciprocating path toward and away from the anvil. The toggle mechanism is movable between an under-center release position, an on-center crimping position and an over-center release position. In accordance with the invention, the location of the connection of the toggle mechanism to the supporting structure can be adjusted to selectively vary the spacing between the die members when the toggle mechanism is in the on-center position to thereby adjust the crimp height.

More particularly, the toggle mechanism includes a screw having one end connected through a universal connection to a driven shaft. A nut is threaded on the screw and is pivotally connected to a pair of toggle links. One of the toggle links is pivotally connected to the ram, while the other toggle link is pivotally connected to an adjusting member that is mounted for movement on the supporting structure. In the preferred form of the invention, the adjusting member takes the form of an externally threaded sleeve which is engaged with the internal thread of a gear, and the gear, in turn, is driven through a worn drive. By operating the worm drive, the gear, through the threaded connection with the sleeve, will move the sleeve to thereby vary the location of the pivotal connection of the toggle mechanism to the supporting structure and thus adjust the spacing between the die members when the ram is in the on-center crimping position, thereby adjusting the crimp height.

With the toggle drive mechanism, as used in the invention, crimping occurs on both the forward and reverse strokes of movement of the toggle mechanism. In the forward stroke of movement, the toggle mechanism moves from an under-center position to an on-center crimping position to an over-center position, and in the reverse direction the toggle mechanism moves from the over-center position to the on-center crimping position to the under-center release position. As the crimping is done on both forward and reverse strokes of movement of the toggle mechanism, the speed of the crimping operation is substantially increased as compared to a crimping machine in which crimping occurs on only one stroke of reciprocating movement.

The invention also provides a simple and convenient adjusting mechanism for adjusting the location of the pivotal connection of the toggle mechanism to the supporting structure which, in turn, adjusts the spacing between the die members when the toggle mechanism is in the on-center crimping position.

The invention also can incorporate a load cell with the adjusting mechanism which provides a measurement of the load or force being applied during the crimping operation.

Other objects and advantages will appear during the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
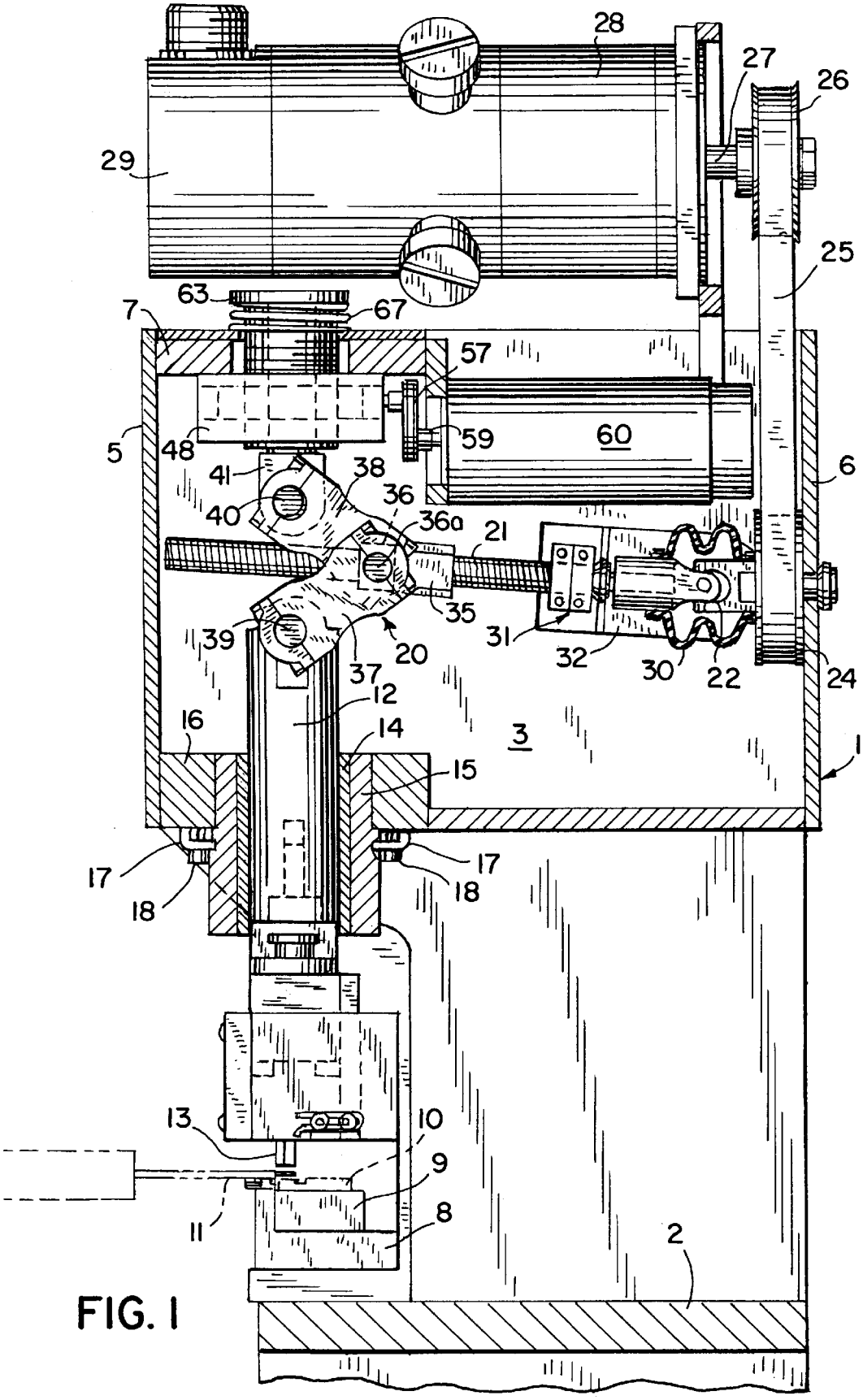
FIG. 1 is a side elevation of the crimping apparatus of the invention with parts broken away in section and showing the toggle mechanism in the under-center position.

The drawings illustrate an improved mechanism for crimping an electrical terminal to the exposed end of an electrical conductor. The apparatus includes a frame or supporting structure 1 having a base 2 and a pair of side plates 3 and 4 which extend upwardly from the base. In addition, the upper ends of the side plates 3 and 4 are joined by a front plate 5 and a rear plate 6. A top plate 7 connects the forward portions of side plates 3 and 4.

Mounted on frame 1 is an anvil 8 that carries a die member 9. Die member 9 supports the terminal 10 which is crimped to the conductor 11 during the crimping operation. The die 9, as well as the mechanism for feeding the conductor 11 to the anvil, and the mechanism for feeding the terminals 10 to the anvil are of conventional construction and can be similar to that described in U.S. Pat. No. 4,707,913.

A ram 12 is mounted for reciprocating movement in a direction toward and away from anvil 8 and the lower end of ram 12 carries a die member 13 which cooperates with die member 9 to crimp the terminal 10 to the conductor wire 11.

Figure 4:
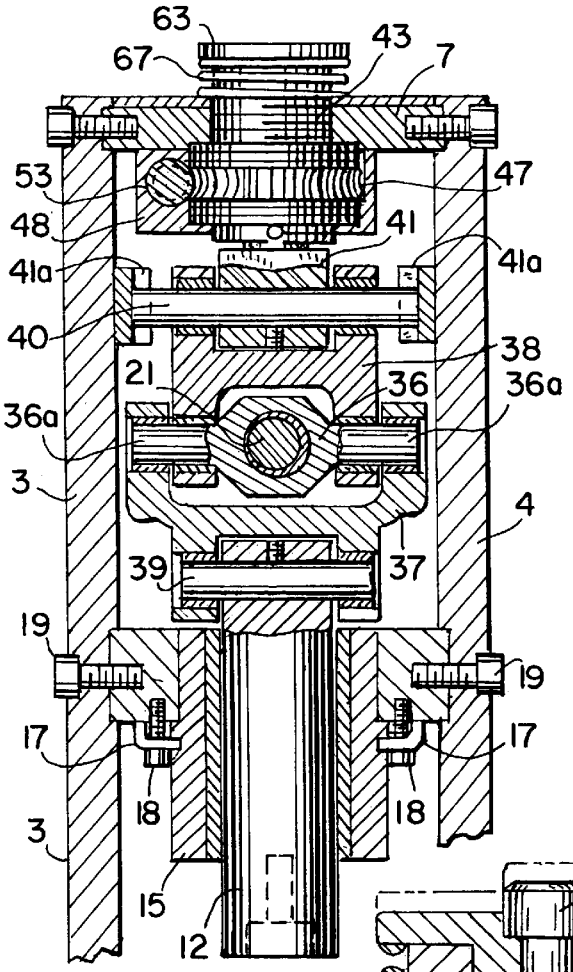
FIG. 4 is an enlarged vertical section taken along line 4—4 of FIG. 2 showing the adjusting mechanism.
Figure 6:
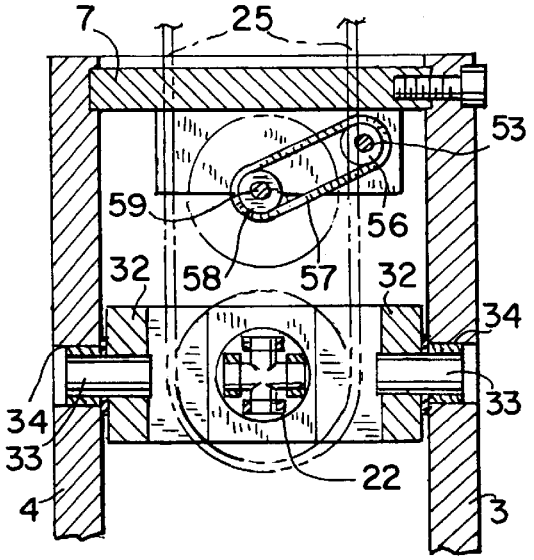
FIG. 6 is a section taken along line 6—6 of FIG. 2.

Ram 12 is guided in reciprocating movement by a caged ball bearing assembly 14 which travels in a sleeve 15. Sleeve 15 is mounted to a plate 16 by a series of clips 17. The lower horizontal leg of each clip 17 is located in an external circumferential groove in sleeve 15, while the upper end of each clip bears against the lower end of plate 16 and screws 18 connect clips 17 with the plate, thus securing sleeve 15 and bearing assembly 14 to the plate. Plate 16 is connected to side plates 3 and 4 by bolts 19, as seen in FIG. 4.

In accordance with the invention, a toggle mechanism 20 interconnects the ram 12 with the supporting structure or frame and acts to move the ram 12 toward anvil 8 to crimp the terminal 10 to the wire 11. The toggle mechanism includes a screw 21 and the rear end of the screw is keyed to a sleeve 21*a*, and the sleeve in turn is connected via a universal joint assembly 22 to the hub 23 of a pulley 24 which is journaled on a shaft 24*a* fixed to rear wall 6. Pulley 24 is connected by timing belt 25 to a pulley 26 mounted on the drive shaft 27 of a motor 28 and an encoder 29 is associated with motor 28. With this construction, operation of the motor 28 will rotate screw 21. A suitable flexible cover or shield 30 is mounted over the universal connection 22.

Figure 5:
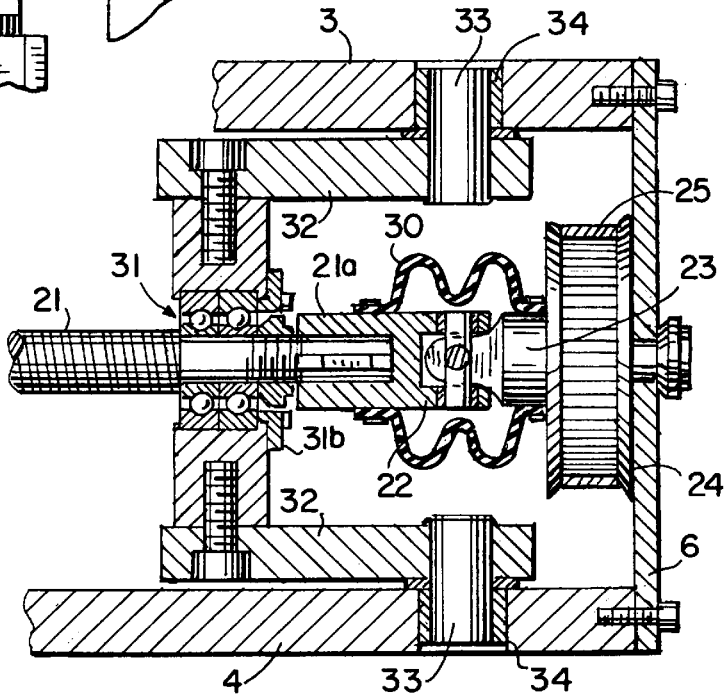
FIG. 5 is a section taken along line 5—5 of FIG. 2.
Figure 10:
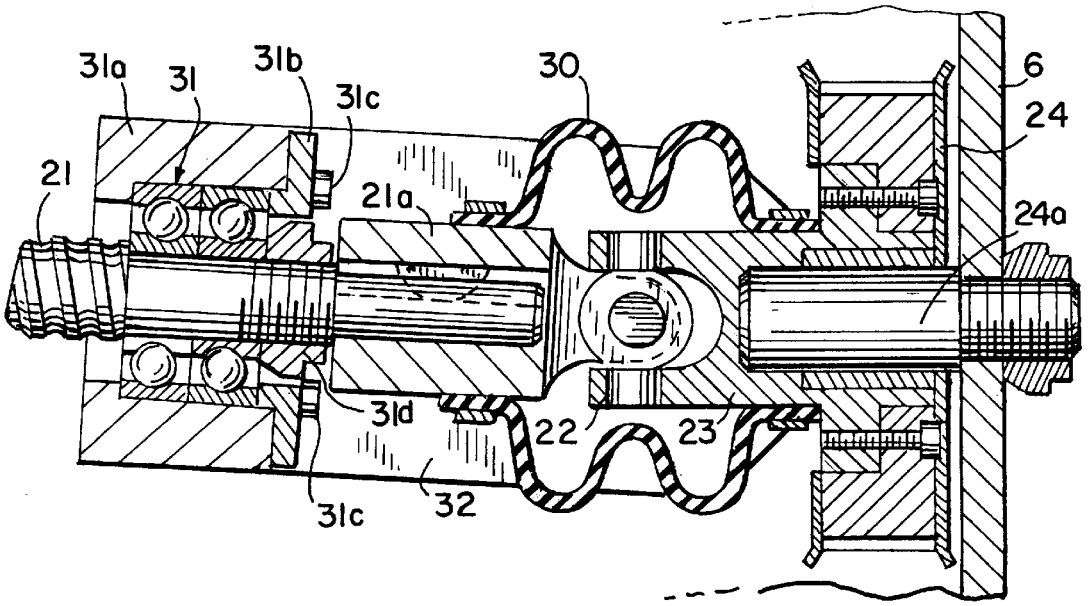
FIG. 10 is an enlarged longitudinal section showing the attachment of the ball screw to the belt drive.

As best seen in FIGS. 5 and 10, the rear portion of screw 21 is journaled for rotation in a bearing assembly 31 which is mounted in carrier 31*a* that is attached to a pair of arms 32 that straddle screw 21. As best shown in FIG. 10, one end of the outer race of bearing assembly 31 bears against an internal shoulder in carrier 31*a* while the corresponding end of the inner race bears against a shoulder on shaft 21. A retaining ring 31*b* engages the opposite end of the outer race of the bearing assembly and is connected to carrier 31*a* by a series of bolts 31*c*. In addition, a nut 31*d* is threaded on shaft 21 and bears against the corresponding end of the inner race, thus locking the bearing assembly 31 to the carrier 31*a*.

The opposite or rear end of each arm 32 carries a stub shaft 33 which is journaled in a bearing assembly 34 mounted in the corresponding side walls 3 and 4. This arrangement permits the screw 21 to tilt about the axes of shafts 33, as will be hereinafter described.

Figure 8:
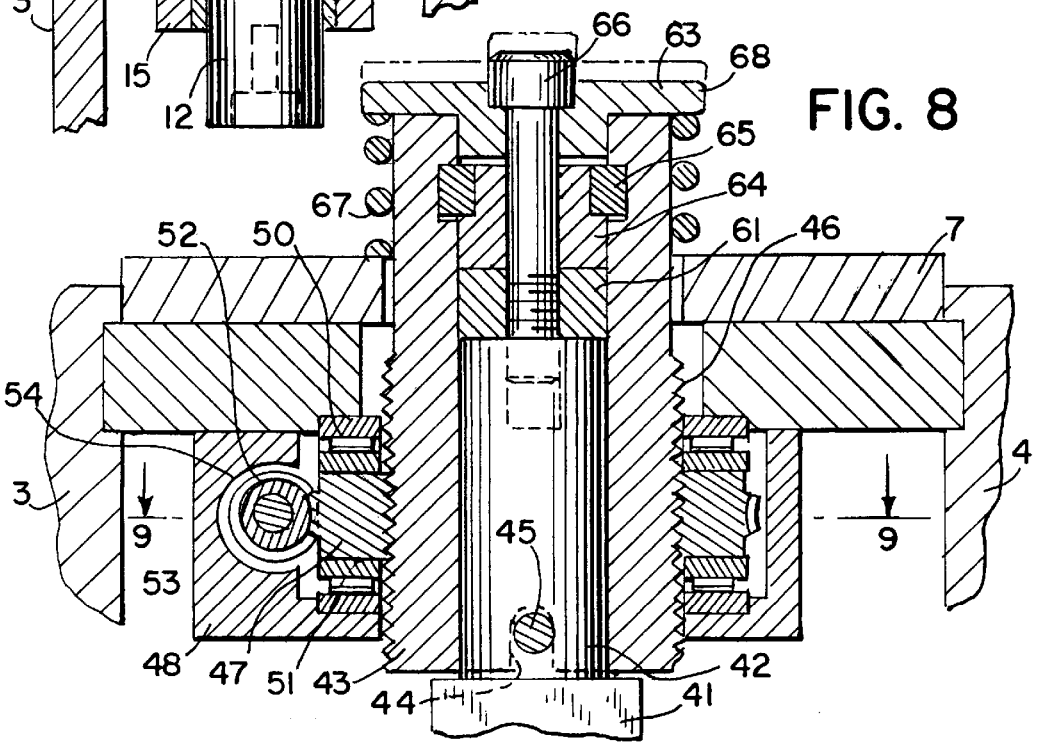
FIG. 8 is a section taken along line 8—8 of FIG. 7.

A recirculating ball nut 35 is threaded on screw 21 and the nut is integral with a trunion 36. Pins 36a extend outwardly from opposite sides of trunion 36 and serve to pivotally connect the trunion to a lower toggle link 37 and an upper toggle link 38, as best shown in FIG. 4. The lower end of toggle link 37 is pivotally connected to the upper end of ram 12 by pin 39 and similarly the upper end of toggle link 38 is connected by pin 40 to an anchor link 41 having a cylindrical upper end portion 42 which is secured in the central bore of a sleeve 43, as shown in FIG. 8. To guide anchor link 41 in movement, the ends of pin 40 ride in vertical guideways 41*a* mounted to the inner surfaces of walls 3 and 4. The lower edge of sleeve 43 is provided with a pair of opposed notches 44 which receive the respective ends of a pin 45 that extends through link 42, thus preventing relative rotation between the link 42 and sleeve 43.

The invention also includes a novel mechanism for adjusting the crimp height which acts to vary the position of the pivotal connection 40 between the upper toggle link 38 and link 41. In this regard, sleeve 43 is provided with an external thread 46 which is engaged with the internal thread on a gear 47 that is mounted for rotation within a recess in plate 48. Plate 48 is secured to the underside of top plate 7 by screws 49. Gear 47 is journaled within the central cavity in plate 48 by a pair of thrust bearings 50 and 51, as seen in FIG. 8. Upper thrust bearing 50 is mounted within an annular recess in the underside of top plate 7, while the lower thrust bearing 51 is mounted within an annular recess bordering the central cavity in plate 48.

Figure 9:
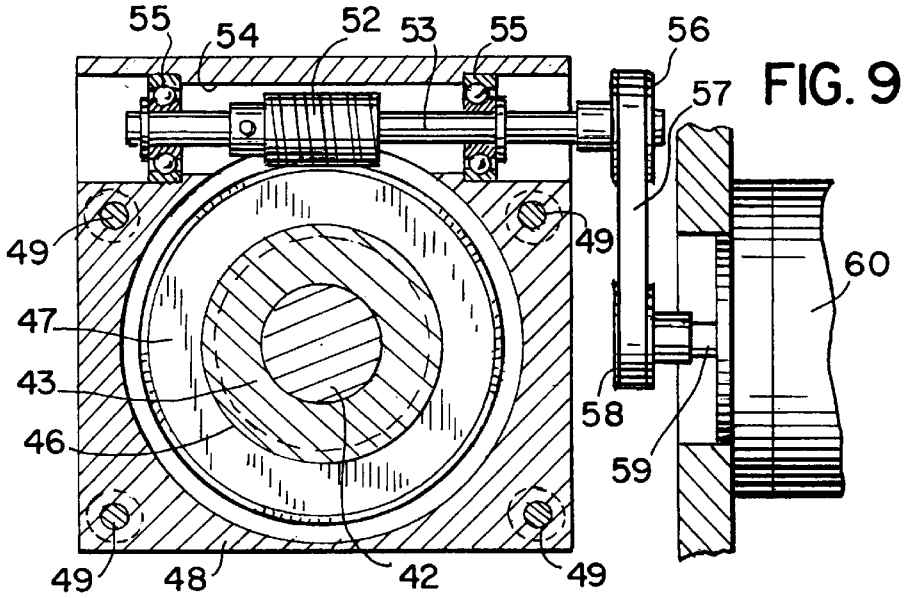
FIG. 9 is a section taken along line 9—9 of FIG. 8.

The teeth on the outer diameter of gear 47 are engaged with a worm 52 which is mounted on horizontal shaft 53. Shaft 53 is located within a bore 54 in plate 48 that communicates with the central cavity that houses gear 47, and the shaft is journaled for rotation by bearings 55, as illustrated in FIG. 9.

An end of shaft 53 projects outwardly of bore 54 and carries pulley 56 which is connected via timing belt 57 to a pulley 58 on the drive shaft 59 of motor 60. Thus, operation of motor 60 will operate through the worm 52 to rotate gear 47 and move sleeve 43 axially. Axial movement of the sleeve will vary the location of the pivotal connection 40 to thereby vary the spacing between the die members 9 and 13 when toggle mechanism 20 is in the on-center or closed position to correspondingly vary the crimp or shut height. Alternately, shaft 53 can be connected to a hand knob, so that manual rotation of the hand knob will provide the adjustment in crimp height as opposed to the power operated system employing motor 60.

Figure 7:
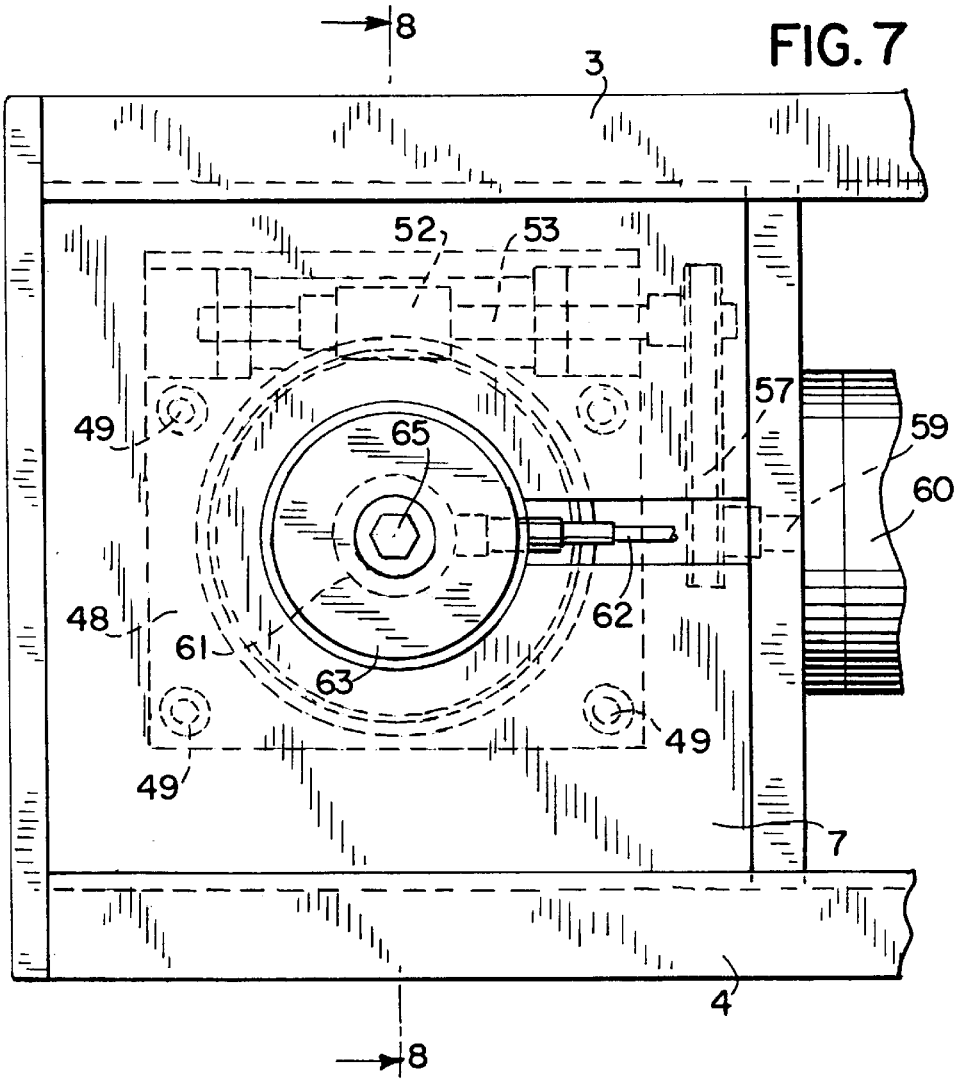
FIG. 7 is an enlarged fragmentary top plan view showing the adjusting mechanism.

The upper end of the central bore in sleeve 43 receives a load cell 61. The electrical connection 62 to the load cell 61 extends through a suitable opening in the side of sleeve 43, as seen in FIG. 7. The load cell 61 provides a measurement of the load or force being applied during the crimping action. A cap 63 encloses the upper end of the bore in sleeve 43, and a spacer 64 is located in the bore between the cap and load cell 61, and is held in position by a split retaining ring 65, as illustrated in FIG. 8. Ring 65 is mounted in an internal groove in the wall of sleeve 43. In addition, a draw bolt 66 extends through aligned holes in cap 63, spacer 64 and load cell 61 and is threaded in an opening in the upper end of section 42 of link 41. Through this construction link 41, cap 63 and sleeve 43 are tied together.

As best seen in FIG. 8, a coil spring 67 is interposed between the peripheral flange 68 of cap 63 and plate 7. The force of spring 67 urges cap 63 and sleeve 43 upwardly, thus urging the gear 47 upwardly toward bearing 50 to preload the threaded connection between sleeve 43 and the gear for backlash.

FIG. 1 shows the toggle mechanism 20 in the under-center open position, where the dies 9 and 13 are spaced apart. In this position the wire 11, as well as the terminal 10, can be fed to the die member 9 on anvil 8 by conventional feeding mechanisms.

Figure 2:
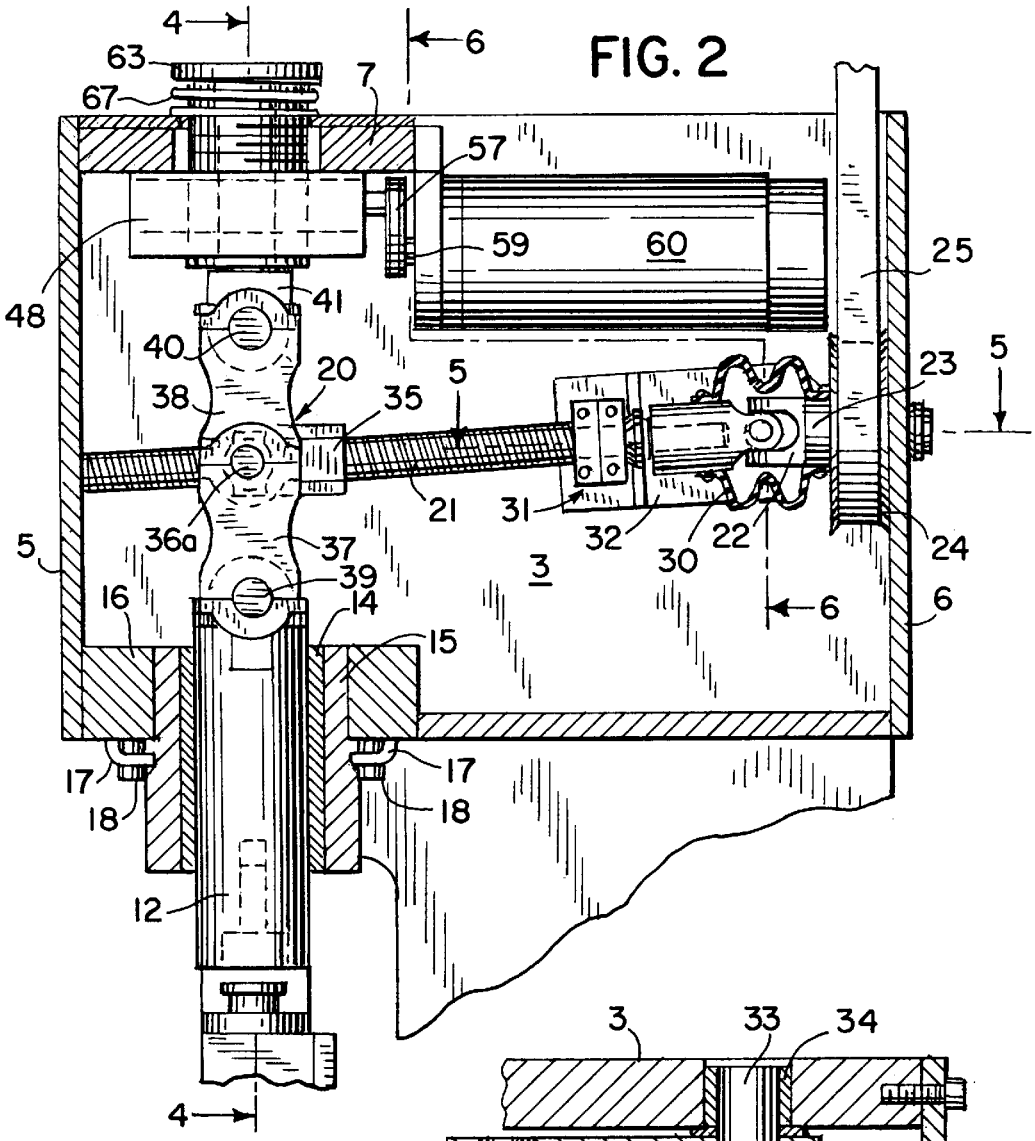
FIG. 2 is a fragmentary view similar to FIG. 1 showing the toggle mechanism is in on-center crimping position.
Figure 3:
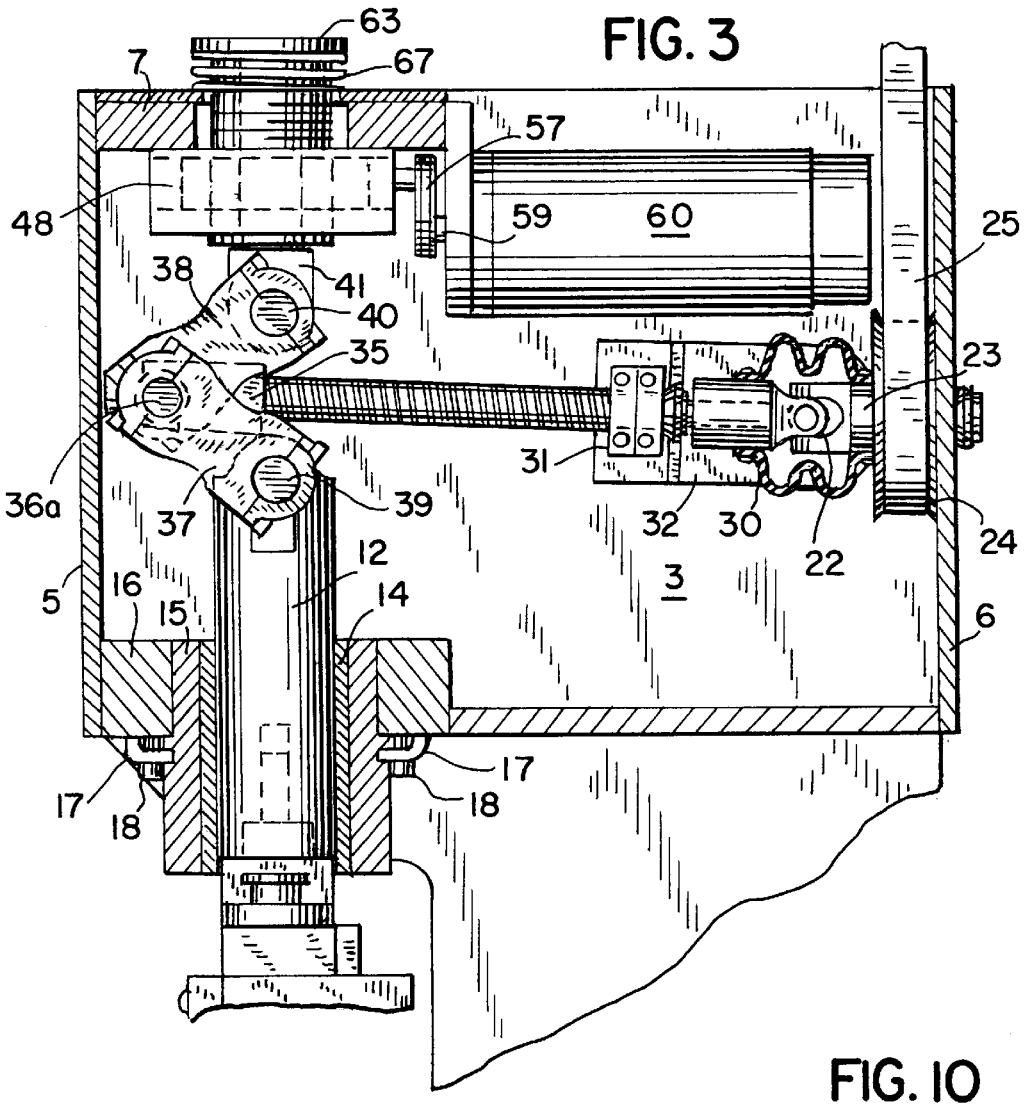
FIG. 3 is a fragmentary view similar to FIG. 1 showing the toggle mechanism in the over-center release position.

Operation of motor 28 will move the toggle mechanism 20 to the on-center or closed position as shown in FIG. 2, thereby moving the ram 12 toward the anvil 8 to crimp the terminal 10 onto the wire 11. Continued operation of motor 28 will move the toggle mechanism 20 to the over-center or release position, as shown in FIG. 3, in which the wire can be withdrawn from the anvil and a second wire and terminal inserted onto the die 9. Reverse operation of the motor 28 will then move the toggle mechanism 20 back to the on-center or closed position, as shown in FIG. 2, causing the second terminal to be crimped onto the wire. Further operation of motor 28 in the reverse direction will move the toggle mechanism 20 back to the original under-center or release position, as shown in FIG. 1 to permit the wire having the crimped terminal to be removed from die 9 and permitting the sequence of operations to be repeated.

If the size or configuration of either the wire or the terminal is changed, the crimp height can be conveniently varied through operation of motor 60, which will cause the location of the pivot 40 to be changed, and thus vary the spacing between the die members 13 and 9 when the toggle mechanism 20 is in the on-center crimping position, thus varying the crimp or shut height. During operation of the toggle mechanism, the screw 21 will pivot about pivotal connection of the arms 32 to the side plates 3 and 4.

The use of the toggle mechanism to actuate the ram enables the crimping action to occur on both forward and reverse strokes, thus increasing the overall speed of the crimping machine.

The invention also includes a simple and convenient mechanism for adjusting the crimp height while not varying the force which is applied to the terminal during the crimping action.

I claim:

1. An apparatus for crimping a terminal to an electrical conductor, comprising a supporting structure, an anvil mounted on the supporting structure, a ram mounted for reciprocating movement on said supporting structure in a direction toward and away from said anvil, said anvil and said ram each carrying cooperating die members arranged to crimp a terminal on an electrical conductor as said ram moves toward said anvil, a toggle mechanism interconnecting said supporting structure and said ram, and including a first toggle link and a second toggle link, first pivot means for pivotally connecting said first toggle link to said ram, second pivot means for pivotally connecting said second toggle link to the supporting structure, a nut pivotally connected to said first and second toggle links, a screw engaged with said nut, reversible drive means operably connected to the screw to rotate the screw, operation of said drive means in one direction acting to move said toggle links from an under-center open position to an on-center crimping position to an over-center open position, and adjusting means for adjusting the position of said second pivot means relative to said supporting structure to thereby adjust the spacing between said die members when said toggle links are in the on-center crimping position.

2. The apparatus of claim 1, wherein said adjusting means comprises a movable member pivotally connected to said second toggle link, and actuating means for moving the movable member in said direction.

3. The apparatus of claim 2, wherein said actuating means comprises a gear having external teeth and an internal thread, said movable member having an external thread engaged with the internal thread of said gear, and means engaged with the external teeth of the gear for rotating said gear, rotation of said gear causing movement of said movable member in said direction.

4. The apparatus of claim 3, and including thrust bearing means for journaling said gear for rotation relative to said supporting structure.

5. The apparatus of claim 1, wherein said reversible drive means comprises a reversible motor and a driven shaft, and a universal coupling connecting said driven shaft to an end of said screw.

6. The apparatus of claim 1, and including means for mounting the screw for tilting movement relative to said supporting structure.

7. The apparatus of claim 6, wherein said means for mounting the screw for tilting movement comprises journaling means for journaling the screw for rotation, support means secured to said journal means, and pivot means mounting said support means for pivotal movement relative to said supporting structure.

8. The apparatus of claim 7, wherein said support means includes a pair of arms that straddle said screw, and said pivot means comprises a pivot shaft carried by each arm and journaled with respect to the supporting structure.

9. The apparatus of claim 4, wherein said thrust bearing means comprises an upper thrust bearing located above said gear and a lower thrust bearing located below said gear, said apparatus also including resilient means for urging said gear upwardly toward said upper thrust bearing to preload the threaded connection between said movable member and said gear for backlash.

10. The apparatus of claim 9, wherein said resilient means comprises a spring interconnecting said movable member and said supporting structure.

11. The apparatus of claim 2, and including force measuring means for measuring the force applied during the crimping operation, said force measuring means being operably connected to said second toggle link.

12. The apparatus of claim 11, wherein said force measuring means is axially aligned with said ram.

13. The apparatus of claim 12, wherein said force measuring means comprises a load cell disposed in a central opening in said movable member.

14. An apparatus for crimping a terminal to an electrical conductor, comprising a supporting structure, an anvil mounted on the supporting structure, a ram mounted for reciprocating movement on said supporting structure in a direction toward and away from said anvil, said anvil and said ram each carrying cooperating die members arranged to crimp a terminal on an electrical conductor as said ram moves toward said anvil, a toggle mechanism interconnecting said supporting structure and said ram and including a first toggle link and a second toggle link, first pivot means for pivotally connecting said first toggle link to said ram, second pivot means for pivotally connecting said second toggle link to the supporting structure, said first toggle link and said second toggle link being connected together at a third pivot means, reversible drive means pivotally connected to said first and second toggle links at said third pivot means, said toggle mechanism having a first under-center open position wherein said first and second toggle links are disposed at an acute angle to each other and said third pivot means is disposed on one side of an axis extending between said ram and said anvil and having an on-center crimping position where said toggle links are aligned and said third pivot means is located substantially on said axis and having an over-center open position wherein said first and second toggle links are at an acute angle with respect to each other and said third pivot means lies on the opposite side of said axis, operation of said drive means in one direction acting to move said toggle links from said under-center open position to said on-center crimping position to said over-center open position and operation of said drive means in the opposite direction moving said toggle links from said over-center open position to said on-center crimping position to said under-center open position, and adjusting means for adjusting the position of said second pivot means relative to said supporting structure to thereby adjust the spacing between said die members when said toggle links are in the on-center crimping position.

* * * * *